US006402864B1

(12) United States Patent
Gill et al.

(10) Patent No.: US 6,402,864 B1
(45) Date of Patent: Jun. 11, 2002

(54) LOW SLAG, REDUCED HAZARD, HIGH TEMPERATURE INCENDIARY

(75) Inventors: Robert C. Gill, White Plains; Carl Gotzmer, Accokeek; Pamela Carpenter; Eric Schlegel, both of Indian Head, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 99 days.

(21) Appl. No.: 09/697,245

(22) Filed: Oct. 27, 2000

(51) Int. Cl.[7] ..... C06B 45/10; C06B 21/00

(52) U.S. Cl. ..... 149/19.9; 149/19.3; 149/19.92; 149/22; 149/108.2; 149/108.6

(58) Field of Search ..... 149/19.3, 19.9, 149/19.92, 22, 108.2, 108.6; 102/364

(56) References Cited

U.S. PATENT DOCUMENTS

| | | | | | |
|---|---|---|---|---|---|
| 2,995,431 | A | | 8/1961 | Bice | 52/5 |
| 3,865,035 | A | * | 2/1975 | Munson et al. | 102/364 |
| 3,986,909 | A | | 10/1976 | Macri | 149/19.9 |
| 4,012,244 | A | * | 3/1977 | Kaufman et al. | 149/19.3 |
| 4,098,625 | A | | 7/1978 | French et al. | 149/19.3 |
| 4,131,498 | A | * | 12/1978 | Lucy | 149/114 |
| 4,262,541 | A | | 4/1981 | Jacobs | 73/826 |
| 4,331,080 | A | | 5/1982 | West et al. | 102/301 |
| 4,397,700 | A | | 8/1983 | Johnson et al. | 149/7 |
| 4,428,786 | A | | 1/1984 | Arni | 149/21 |
| 4,482,405 | A | | 11/1984 | Wright | 149/19.3 |
| H169 | H | * | 12/1986 | Mackenzie et al. | 149/108.6 |
| 4,944,815 | A | | 7/1990 | Consaga | 149/19.1 |
| 4,978,400 | A | * | 12/1990 | Juneau et al. | 149/109.6 |
| 5,187,320 | A | | 2/1993 | Yunan | 102/275.8 |
| 5,253,584 | A | * | 10/1993 | Allford | 149/19.3 |
| 5,468,313 | A | | 11/1995 | Wallace, II et al. | 149/53 |
| 5,529,649 | A | | 6/1996 | Lund et al. | 149/19.3 |
| 5,880,398 | A | * | 3/1999 | Crilly et al. | 102/364 |
| 6,354,222 | B1 | * | 3/2002 | Becker et al. | 102/323 |

* cited by examiner

*Primary Examiner*—Edward A. Miller
(74) *Attorney, Agent, or Firm*—Mark Homer

(57) ABSTRACT

A high temperature incendiary composition having a reactive material of titanium, a second reactive material of boron, an oxidizer of polytetrafluoroethylene in an amount of from about 20 weight percent or greater of the composition and a binder of CTBN in an amount of from about 10 weight percent or less. The composition is safe to handle, ignites readily, produces low slag, burns at a low and controlled rate and produces a very high flame temperature.

12 Claims, No Drawings

LOW SLAG, REDUCED HAZARD, HIGH TEMPERATURE INCENDIARY

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention relates to incendiary compositions. More particularly, the incendiary composition of the present invention contains a CTBN binder to improve ESD sensitivity of titanium/boron/polytetrafluoroethylene compositions. Most particularly, the CTBN binder is present in amounts of from about 10% or less combined with polytetrafluoroethylene in amounts of from about 20% or more.

2. Brief Description of the Related Art

Reducing the electrostatic discharge sensitivity (ESD) for dry metals is particularly important in the manufacture of incendiary devices. Highly reactive metals provide an excellent source for high burn temperatures, however, the more reactive the metal powders are, the more ESD sensitive they become. ESD sensitive metal powders are likely to ignite during handling or mixing, increasing hazards to personnel and manufacturing equipment. Combinations of titanium and boron potentially possess extremely high ESD sensitivity, with ignition of approximately 0.0084 joules possible. Other types of metallic mixtures that are less ESD sensitive, such as iron oxide and aluminum, i.e., Thermite, burn too quickly and with relatively low flame temperatures. Some combinations of magnesium, teflon and Viton A, e.g., MTV, have a high flame temperature, but they don't have the slow burning rate.

In view of the foregoing, there is a need for improved incendiary compositions for having a low slag, low ESD sensitivity and high flame temperature. The present invention addresses this need.

SUMMARY OF THE INVENTION

The present invention includes a low slag, high temperature incendiary composition 15 comprising a reactive material of titanium, a second reactive material of boron, an oxidizer of polytetrafluoroethylene in an amount of from about 20 weight percent or greater of the composition and a CTBN binder in an amount of from about 10 weight percent or less, wherein the ratio of titanium to boron ranges from about 81/19 to about 69/31.

The present invention also includes a method of producing a low slag, high temperature incendiary composition comprising the steps of mixing a first combination of a reactive material of titanium with a second reactive material of boron and an oxidizer of polytetrafluoroethylene, wherein the polytetrafluoroethylene comprises an amount of from about 20 weight percent or greater of the composition and the ratio of titanium to boron ranges from about 81/19 to about 69/31 and adding a CTBN binder in an amount of from about 10 weight percent or less to the first combination.

Additionally, the present invention includes a high flame temperature product from the process comprising the steps of providing an incendiary composition of titanium, boron, polytetrafluoroethylene in an amount of from about 20 weight percent or greater of the composition, with the ratio of titanium to boron ranges from about 81/19 to about 69/31, and adding a CTBN binder in an amount of from about 10 weight percent or less, and igniting the composition.

Furthermore, the present invention includes a low slag, high temperature incendiary composition product from the process comprising the steps of mixing a first combination of a reactive material of titanium with a second reactive material of boron and an oxidizer of polytetrafluoroethylene, wherein the polytetrafluoroethylene comprises an amount of from about 20 weight percent or greater of the composition and the ratio of titanium to boron ranges from about 81/19 to about 69/31 and adding a CTBN binder in an amount of from about 10 weight percent or less to the first combination.

The present invention provides an incendiary composition having a low slag and high flame temperature that is safer to handle and mix because of a reduced sensitivity to ESD.

DETAILED DESCRIPTION OF THE PREFERRED EMBODIMENT

The present invention relates to incendiary compositions with improved electrostatic discharge (ESD) sensitivity. The incendiary compositions contain a carboxyl-terminated butadiene/acrylonitrile copolymer (CTBN) binder to improve ESD sensitivity of titanium, boron and polytetrafluoroethylene composition mixtures. The incendiary compositions are safe to handle, ignite readily, provide low slag and produce a very high flame temperature.

Safe ESD sensitivity for manufacture and handling of the present invention is in the range greater than 0.023 joules. The human body is capable of producing approximately 0.0084 joules. The high temperature incendiary composition of the present invention contains a reactive material of titanium, a second reactive material of boron, an oxidizer of polytetrafluoroethylene, which further includes a CTBN binder that increases the ESD resistance for the titanium/boron/polytetrafluoroethylene combination to a value of more than 0.023 joules.

Low slag for the present invention includes a slag percentage of less than 30% at a compaction of approximately 50% of the theoretical maximum density (TMD) of the composition. The slag is defined as the amount of solids that remain as a solid mass, at or near the location where the material is burned. A primary use for the present invention is to heat the air and surroundings to a high temperature. Therefore the hot particles produced from the burning need to transfer their heat to the air as quickly and efficiently as possible. The less solid slag produced, the more fine particles are ejected into the air and the more efficient is the transfer process.

Calculations show that mixture of the two reactive metals, titanium and boron, form an intermetallic compound together upon ignition. Solid titanium and boron react to form a liquid, i.e., molten, intermetallic compound, indicated by the formula:

$$Ti+2B \rightarrow TiB_2$$

Other by-products occur, most significantly with the reaction of boron with polytetrafluoroethylene, and the reaction of the CTBN binder ingredients with titanium.

The titanium preferably comprises a particle size of from greater than 44 microns to about 150 microns, with ESD sensitivity increasing to unsafe levels below 44 microns and burn rates increasing beyond a slow burn rate above a particle size of from about 150 microns. Particle sizes of about 200 microns provide a burning rate of approximately 4.7 inches per minute or 321 grams per minute. Appropriate particle sizes for the titanium within the particle size range of from about 44 microns to about 150 microns may be used as determine by those skilled in the art for a given purpose in light of the disclosure herein. Boron particles may include any acceptable size, such as from about 0.5 microns to about 1 micron in size, as determined by one of ordinary skill in the art. The chemicals are commercially available in finely divided powders. Titanium powder metal is available from Atlantic Equipment Engineers of Bergenfield, N.J. under the catalog number TI-109, having a purity of 99.7%. Boron is available from Callery Chemical Company of Pittsburgh, Pa. under the tradename SB 95 having from about 95% to about 97% boron and from about 5% to about 3% magnesium oxide (MgO) or SB 90 having from about 90% to about 92% boron and from about 10% to about 8% magnesium oxide (MgO), with both products having an amorphous state with an average particles size of approximately 0.6 microns. Titanium amounts preferably include from about 41 weight percent to about 61 weight percent, and more preferably from about 51 weight percent to about 61 weight percent, with boron in amounts of from about 11 weight percent to about 24 weight percent, more preferably from about 14 weight percent to about 24 weight percent. For example, titanium may comprise approximately 60.75 weight percent and boron approximately 14.25 weight percent of the total composition.

The weight ratio amount of titanium to boron needed for a high flame temperatures range from about 81/19 to about 69/31. Preferably within this range, the titanium and boron are present in the composition in substantially stoichiometric proportions for forming the intermetallic compound. As the ratio of titanium to boron decreases, the combination metal becomes increasingly more difficult to ignite, with the proper ratio of titanium to boron for a given incendiary composition determinable by those skilled in the art in light of the disclosure herein.

The incendiary composition includes an oxidizer of polytetrafluoroethylene, also known as Teflon®, in an amount of from about 20 weight percent or greater of the composition. Preferred amounts of polytetrafluoroethylene range from about 20 weight percent to about 30 weight percent, with more preferred amounts of polytetrafluoroethylene ranging from about 20 weight percent to about 25 weight percent. The particles of the polytetrafluoroethylene may be any suitable size, such as from about 20 microns to about 450 microns, with little affect on the burning rate or slag percentage. As the amount of polytetrafluoroethylene increases, the reaction energy of the titanium/boron ignition decreases, with the proper amount of polytetrafluoroethylene for a given incendiary composition determinable by those skilled in the art in light of the disclosure herein. Polytetrafluoroethylene is available from E.I. duPont de Nemours & Company of Wilmington, Del. under the tradename Teflon® 7C.

The CTBN binder is included within the incendiary composition in an amount of from about 10 weight percent or less. Preferred amounts of CTBN binder range from about 4 weight percent to about 6 weight percent, with more preferred amounts of carboxyl-terminated acrylonitrile being approximately 5 weight percent. CTBN binder is a liquid at ordinary temperatures but when heated will cure to form a rubber-like material. As the amount of CTBN binder increases, the flame temperature decreases and slag increases, with the proper amount of CTBN binder for a given incendiary composition determinable by those skilled in the art in light of the disclosure herein. CTBN is available from B.F. Goodrich Company in Breckville, Ohio under the Hycar® 1300 series of polymers. The CTBN may be accompanied by additive components determinable by one skilled in the art including plasticizers such as dioctyl adipate (DOA) available from Union Camp Corporation in Wayne, N.J.; wetting agents such as lecithin (soy phospholipids, phosphatides) available from American Lecithin Company in Danbury, Conn.; crosslinkers such as Araldite® MY 0510 (4-glycidyloxy-N,N-Diglycidylaniline) available from Ciba Specialty Chemicals Corporation in Brewster, N.Y.; and/or curing catalysts such as Fomrez® C-2 (stannous octoate) available from Witco Chemicals, Organic Division in Huston, Tex. For examples, the 10% CTBN binder may be composed of 4.70% CTBN, 2.60% DOA, 2.00% lecithin, 0.62% Araldite MY 0510, and 0.08% Fomrez C-2, with the percentages of the additives in the binder are decreased proportionately as the CTBN binder decreases. The percentages of the additives in the binder can also vary as necessary to achieve certain characteristics as determinable by one skilled in the art of formulating.

The incendiary composition may be manufactured in a safe manner by using the binder to decrease the electrostatic discharge hazard during handling and mixing. The preferred method for preparing the invention includes adding the non-binder components, i.e., titanium, boron and polytetrafluoroethylene, into a bowl before mixing, but other procedures were successfully used in the small scale development mixes. After the component powders are added, the electrostatic field (E-field) is measured. A commercially available electrostatic fieldmeter is used and measurement is determined according to the manufacturer's directions. E-field measurements of 3 kilovolts per inch or less permit the method to proceed, with the addition of the CTBN binder. Once the CTBN binder has been added, the components are mixed for a total of approximately two and one-halfhours. Every half hour, during the first two and one hours, the mix is stopped and the blades and sides of the bowl are scrapped with a conductive spatula.

A high flame temperature product results with the ignition of the incendiary composition of the 81/19 to 69/31 ratio of titanium and boron, 20 weight percent or more polytetrafluoroethylene and 10 weight percent or less CTBN binder. Temperatures of the incendiary composition igniting may range from about 3500° F. or higher, with temperatures from about 4000° F. to about 5000° F. preferred, such as approximately 4600° F. As the incendiary composition comprises lesser amounts of CTBN binder, such as 5 weight percent or less, the flame temperature increases. As the incendiary composition comprises less polytetrafluoroethylene, such as from about 20 weight percent to about 25 weight percent, the reaction energy increases.

EXAMPLE 1

5% CTBN/60.75% Ti/14.25% B/20% Teflon

Titanium in an amount of 48.60 pounds was placed in a twenty-five gallon horizontal mixer in which a temperature of 140° F. was maintained. Boron in an amount of 11.40 pounds was added to the horizontal mixer, as well as polytetrafluoroethylene in an amount of 16.00 pounds. The E-field was measured at less than 3 kilovolts per inch. CTBN binder ingredients in an amount of 4.00 pounds were added to the mixer. After the CTBN was added, the components were mixed for a total of approximately two hours. Every half hour, during the first one and one-half hours, the mixture was stopped and the blades and sides of the bowl were scrapped with a conductive spatula.

The 80 pounds of incendiary composition had a Ti/B ratio of 81/19. The ESD was measured at 0.095 joules. The bum rate was measure at 1.7 inches per minute or 163 grams per minute (sample was burned in the "FORBON" tube), slag was measured at 36% when compacted to 64% of the theoretical-maximum-density of the composition, and at 57% when compacted to 81% of the theoretical-maximum-density of the composition. At approximately 50% of the theoretical-maximum-density of the composition, the % slag is expected to be in the range of from about 20% to about 25%.

EXAMPLE 2

5% CTBN/51.67% Ti/23.33% B/20% Teflon

Titanium in an amount of 1033.40 g was placed in a one-gallon vertical mixer in which a temperature of 140° F. was maintained. Boron in an amount of 466.60 g was added to the vertical mixer, as well as polytetrafluoroethylene in an amount of 400.00 g. The E-field was measured at less than 3 kilovolts per inch. CTBN binder ingredients in an amount of 100.00 g were added to the mixer. After the CTBN was added, the components were mixed for a total of approximately two hours. Every half hour, during the first one and one-half hours, the mixture was stopped and the blades and sides of the bowl were scrapped with a conductive spatula.

The 2000 g of incendiary composition had a Ti/B ratio of 69/31. Approximately one pound of this material was compacted to 55% of its theoretical-maximum-density in a two diameter combustible tube and burned. The composition burned at 1.2 in/min and left 32% slag.

EXAMPLE 3

5% CTBN/56.70% Ti/13.30% B/25% Teflon 4.70 g of the carboxyl-terminated butadiene/acrylonitrile copolymer, 2.60 g of dioctyl adipate, 2.00 g of lecithin, and 0.08 g of Fomrez C-2 were placed in a 1-pint vertical mixer in which a temperature of 140° F. was maintained. 113.40 g of titanium, 26.60 g of boron, and 50.00 g of Teflon® were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 0.62 g of the crosslinker, Araldite® MY 0510 was added and mixing continued for another thirty minutes. The remainder of the solids were put in the mixer and mixed for a final sixty minutes.

The 200 g of this material had a Ti/B ratio of 81/19. When 189 g of this material was compacted to approximately 50% of its theoretical-maximum-density, 29% slag was left after the composition was burned.

EXAMPLE 4

5% CTBN/60.75% Ti/14.25% B/20% Teflon 15 4.70 g of the carboxyl-terminated butadiene/acrylonitrile copolymer, 2.60 g of dioctyl adipate, 2.00 g of lecithin, and 0.08 g of Fomrez C-2 were placed in a 1-pint vertical mixer in which a temperature of 140° F. was maintained. 121.50 g of titanium, 28.50 g of boron, and 40.00 g of Teflon® were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 0.62 g of the crosslinker, Araldite® MY 0510 was added and mixing continued for another thirty minutes. The remainder of the solids were put in the mixer and mixed for a final sixty minutes.

The 200 g of this material had a Ti/B ratio of 81/19. When 188 g of this material was compacted to approximately 50% of its theoretical-maximum-density, the composition had a burning rate of 1.4 in/min and left 27% slag.

COMPARATIVE EXAMPLE 1

5% CTBN/76.95% Ti/18.05% B/0% Teflon 4.70 g of the carboxyl-terminated butadiene/acrylonitrile copolymer, 2.60 g of dioctyl adipate, 2.00 g of lecithin, and 0.08 g of Fomrez C-2 were placed in a 1-pint vertical mixer in which a temperature of 140° F. was maintained. 153.90 g of titanium and 36.10 g of boron were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 0.62 g of the crosslinker, Araldite® MY 0510 was added and mixing continued for another thirty minutes. The remainder of the solids were put in the mixer and mixed for a final sixty minutes.

The 200 g of this material had a Ti/B ratio of 81/19. When approximately 188 g of this material was compacted to approximately 50% of its theoretical-maximum-density, the composition had a burning rate of 2.6 in/min and left 82% slag.

COMPARATIVE EXAMPLE 2

5% CTBN/68.84% Ti/16.16% B/10% Teflon 330.5 g of the carboxyl-terminated butadiene/acrylonitrile copolymer, 182.8 g of dioctyl adipate, 140.1 g of lecithin, and 5.6 g of Fomrez C-2 were placed in a 5-gallon vertical mixer in which a temperature of 140° F. was maintained. 21.34 lbs of titanium, 5.01 lbs of boron, and 3.10 lbs of Teflon® were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 43.6 g of the crosslinker, Araldite® MY 0510 was added and mixing continued for another thirty minutes. The remainder of the solids were put in the mixer and mixed for a final sixty minutes.

The 31 lbs of this material had a Ti/B ratio of 81/19. When 190 g of this material compacted to approximately 50% of its theoretical-maximum-density, the composition had a burning rate of 1.6 in/min and left 44% slag.

COMPARATIVE EXAMPLE 3

15% CTBN/60.75% Ti/14.25% B/10% Teflon 14.10 g of the carboxyl-terminated butadiene/acrylonitrile copolymer, 7.80 g of dioctyl adipate, 6.00 g of lecithin, and 0.24 g of Fomrez C-2 were placed in a 1-pint vertical mixer in which a temperature of 140° F. was maintained. 121.50 g of titanium, 28.50 g of boron, and 20.00 g of Teflon® were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 1.86 g of the crosslinker, Araldite® MY 0510 was added and mixing continued for another thirty minutes. The remainder of the solids were put in the mixer and mixed for a final sixty minutes.

The 200 g of this material had a Ti/B ratio of 81/19. When 190 g of this material was compacted to approximately 50% of its theoretical-maximum-density, the composition had a burning rate of 1.6 in/min and left 83% slag.

COMPARATIVE EXAMPLE 4

5% CTBN/58.56% Ti/26.44% B/10% Teflon 4.70 g of the carboxyl-terminated butadiene/acrylonitrile copolymer, 2.60 g of dioctyl adipate, 2.00 g of lecithin, and 0.08 g of Fomrez C-2 were placed in a 1-pint vertical mixer. 117.12 g of titanium, 52.88 g of boron, and 20.00 g of Teflon®were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 0.62 g of the crosslinker, Araldite® MY 05 10 was added and mixing continued for another thirty minutes. The remainder of the solids were put in the mixer and mixed for a final sixty minutes.

The 200 g of this material had a Ti/B ratio of 69/31. When 199 g of this material was compacted to approximately 50% of its theoretical-maximum-density, the composition had a burning rate of 2.9 in/min and left 42% slag.

COMPARATIVE EXAMPLE 5

15% CTBN/51.67% Ti/23.33% B/10% Teflon 14.10 g of the carboxyl-terminated butadiene/acrylonitrile copolymer, 7.80 g of dioctyl adipate, 6.00 g of lecithin, and 0.24 g of Fomrez C-2 were placed in a 1-pint vertical mixer in which a temperature of 140° F. was maintained. 103.34 g of titanium, 46.66 g of boron, and 20.00 g of Teflon® were weighted in separate containers, and approximately one-fourth of each of these solids were added to the bowl and mixed for 30 minutes. The inside of the bowl and the mixer blades were scrapped down after this and each subsequent cycle. The second and third portion of the solids were added before the next two fifteen minute cycle. Then 1.86 g of the crosslinker, Araldite® MY 0510 was added and mixing continued for another thirty minutes. The remainder of the solids were put in the mixer and mixed for a final sixty minutes.

The 200 g of this material had a Ti/B ratio of 69/31. When 189 g of this material was compacted to approximately 50% of its theoretical-maximum-density, the composition had a burning rate of 1.1 in/min and left 70% slag.

The foregoing summary, description, and examples of the invention are not intended to be limiting, but are only exemplary of the inventive features which are defined in the claims.

What is claimed is:

1. A low slag, high temperature incendiary composition comprising:

a reactive material of titanium;

a second reactive material of boron;

an oxidizer of polytetrafluoroethylene in an amount of from about 20 weight percent or greater of the composition; and, a carboxyl terminated butadiene/acrylonitrile copolymer (CTBN) binder in an amount of from about 10 weight percent or less;

wherein the ratio of titanium to boron ranges from about 81/19 to about 69/31.

2. The incendiary composition of claim 1, wherein the amount of CTBN binder ranges from about 4 weight percent to about 6 weight percent.

3. The incendiary composition of claim 2, wherein the CTBN binder is present in an amount of approximately 5 weight percent.

4. The incendiary composition of claim 1, wherein the amount of polytetrafluoroethylene ranges from about 20 weight percent to about 30 weight percent.

5. The incendiary composition of claim 4, wherein the amount of polytetrafluoroethylene ranges from about 20 weight percent to about 25 weight percent.

6. The incendiary composition of claim 5, wherein the polytetrafluoroethylene is present in an amount of approximately 20 weight percent.

7. The incendiary composition of claim 1, wherein the amount of titanium ranges from about 41 weight percent to about 61 weight percent.

8. The incendiary composition of claim 7, wherein the amount of titanium ranges from about 51 weight percent to about 61 weight percent.

9. The incendiary composition of claim 1, wherein the amount of boron ranges from about 11 weight percent to about 24 weight percent.

10. The incendiary composition of claim 9, wherein the amount of boron ranges from about 14 weight percent to about 24 weight percent.

11. A method of producing a low slag, high temperature incendiary composition, comprising the steps of:

mixing a first combination of a reactive material of titanium with a second reactive material of boron and an oxidizer of polytetrafluoroethylene, wherein the polytetrafluoroethylene comprises an amount of from about 20 weight percent or greater of the composition and the ratio of titanium to boron ranges from about 81/19 to about 69/31; and, adding a carboxyl terminated butadiene/acrylonitrile copolymer (CTBN) binder in an amount of from about 10 weight percent or less to the first combination.

12. A low slag, high temperature incendiary composition product from the process comprising the steps of:

mixing a first combination of a reactive material of titanium with a second reactive material of boron and an oxidizer of polytetrafluoroethylene, wherein the polytetrafluoroethylene comprises an amount of from about 20 weight percent or greater of the composition and the ratio of titanium to boron ranges from about 81/19 to about 69/31; and, adding a carboxyl terminated butadiene/acrylonitrile copolymer (CTBN) binder in an amount of from about 10 weight percent or less to the first combination.

* * * * *